United States Patent [19]

Yokote et al.

[11] Patent Number: 4,823,562

[45] Date of Patent: Apr. 25, 1989

[54] BAND FOR WATCH

[75] Inventors: Takasuke Yokote; Nobuo Kamimura, both of Tokyo, Japan

[73] Assignees: Shoyo Sangyo Co., Ltd.; Seiko Instruments Inc., both of Tokyo, Japan

[21] Appl. No.: 51,470

[22] Filed: May 18, 1987

[30] Foreign Application Priority Data

May 16, 1986 [JP] Japan ..... 61-111959

[51] Int. Cl.[4] ..... A44C 5/00

[52] U.S. Cl. ..... 63/5.1; 63/9; 224/267; 224/219

[58] Field of Search ..... 63/4, 5 R, 11, 3, 9; 59/80, 90, 79.1, 900; 224/254, 267, 175, 164, 178, 219

[56] References Cited

U.S. PATENT DOCUMENTS 3,063,058 11/1962 Vollet ..... 63/5 R
4,609,786 9/1986 Omoto ..... 63/9

FOREIGN PATENT DOCUMENTS 547945 9/1956 Italy ..... 63/5 R
8571 of 1902 United Kingdom ..... 63/9

*Primary Examiner*—Richard J. Johnson
*Attorney, Agent, or Firm*—Bruce L. Adams; Van C. Wilks

[57] ABSTRACT

An integral watch band is comprised of a plurality of beam portions adjacent to one another in the lengthwise direction of the band. Each beam portion has two major faces opposed to each other and two side faces disposed between the two major faces in opposed relation to each other in the widthwise direction of the band so as to define between a pair of adjacent beam portions a corresponding pair of side faces adjacent to each other in the lengthwise direction. Each pair of adjacent side faces has a pair of arm portions protruding outwardly from the respective adjacent side faces in the widthwise direction. A plurality of elastic bridge portions are integrated with the beam portions through the arm portions to form the integral band. Each bridge portion is elastically connected between each pair of arm portions to enable the integral band to expand and contract in the lengthwise direction. Each bridge portion lies in a first plane which intersects with a second plane containing a beam portion major face and is elastically deformable in the lengthwise direction along the first plane.

7 Claims, 1 Drawing Sheet

FIG.
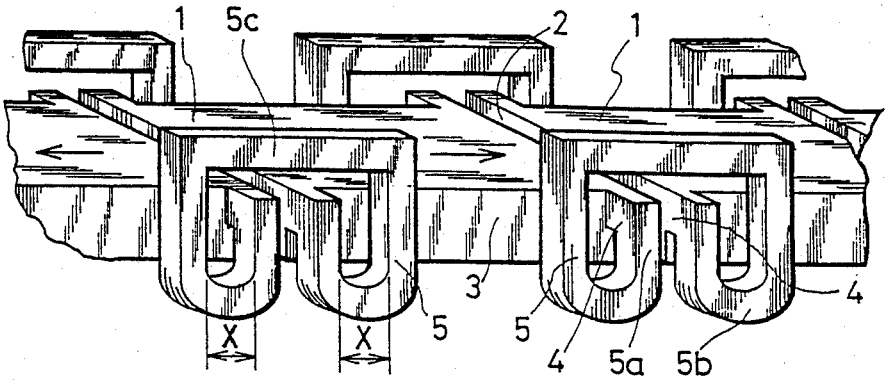

BAND FOR WATCH

BACKGROUND OF THE INVENTION

The present invention relates to a structure of a watch band and to a method of manufacturing the same.

Among various types of watch band, the type that enables watches to be worn most easily is the so-called expansion band. This is because, since the main body of a band of this type expands or contracts, one only has to expand the band and slip one's hand through it when putting the watch on one's wrist. In addition, the bands of other types involve such troublesome tasks as inserting the pin of a fastener into a hole in the band, in the case of a leather band, or engaging one end of the band with a fastener at the other end whenever the watch is to be put on. For these reasons, bands capable of expanding and contracting have conventionally been called expansion bands and used as watch bands.

A conventionally used expansion band is made of metal. Such a band has about 40 to 50 links linked together. A metal plate spring capable of deflection in the thickness direction of the band is inserted into each link, and spring stoppers, more specifically two spring stoppers per link, are inserted between the plate spring and the link from both sides of the link. Adjacent spring stoppers which are disposed on one of the respective sides thereof and inserted into the corresponding adjacent links are inserted into the other of the respective sides thereof between a rear plate and a plate spring within the rear plate. Since the width of a rear plate in the longitudinal direction of the band is equal to the width of a link, the links, the spring stoppers, and the rear plates are thus linked to each other in the successive order of a link, a spring stopper, a rear plate, a spring stopper, a link, a spring stopper, a rear plate, a spring stopper, and so on. When the band is expanded, the links and the rear plates are displaced in the longitudinal direction of the band, causing the spring stoppers to be inclined so that the sides of the spring stoppers at the center of the links cause deflection of the plate spring. Due to the resilience of the plate springs, the expanded band tends to contract again. The above description concerns a conventional expansion band.

A conventional expansion band has the above-mentioned structure. However, an expansion band with such a structure suffers from the following problems. The first problem is the large number of component parts. The entire structure of a band has 40 to 50 links, each with a plate spring received therein. In addition, two spring stoppers are provided for each link, and rear plates are required correspond in number to the links, each also requiring a plate spring received therein. Accordingly, if a band has 40 links, the additional component parts required for the entire structure of the band will be 40 rear plates, 80 ($40+40=80$) plate springs, and 80 ($40\times2=80$) spring stoppers; the total number of these component parts is 240.

The second problem is encountered during assembly, and relates to the first problem. The assembly operation not only has to cope with the large number of component parts but also necessarily involves the steps of inserting a plate spring into each link and each rear plate, bending both ends of the plate springs in order to prevent disengagement of the plate springs, inserting spring stoppers into the respective gaps between the link and the plate spring and the rear plate and the plate spring, and finally caulking the rear plate in order to prevent disengagement of the spring stoppers. A band cannot be constructed until these steps have been completed with respect to all the links. The third problem is that the conventional structure of an expansion band fails to meet the recent demand for watches that are fashionable. Because these bands are made of metal, the variation of colors is limited. Although it is possible to vary the color by coating, some methods of coating may cause a problem relating to the expansion and contraction of the band, while others may suffer from the disadvantage of possible scaling off of the coating, thus failing to provide a solution to the problem. In addition, since manufacturing methods mainly comprise the work of bending metal, the work is necessarily restricted in a number of aspects, making it difficult for use of such a method to establish the desired structure of an expansion band using links and other component parts with unrestricted configuration.

SUMMARY OF THE INVENTION

It is an object of the invention to achieve a reduction of parts.

It is another object of the invention to achieve a cost reduction of the production of the watch band.

A further object of the invention is to achieve increase of color variety of the watch band.

Other and further objects, features and advantages of the invention will appear fully from the following discription.

BRIEF DESCRIPTION OF THE DRAWING

The single drawing is a perspective view of links and elastic members of the band for a watch in accordance with the present invention.

DETAILED DESCRIPTION OF THE INVENTION

In order to solve the above-mentioned problems, the present invention provides a band for a watch in which links of the band and elastic members for enabling elastic expansion and contraction of the band are formed integrally of the same macromolecular material. The elastic members link the respective pairs of adjacent links of the band at the side surfaces of the links of the band, and can be deformed so as to enlarge or reduce the gaps between the links of the band, thereby enabling expansion and contraction of the entire length of the band.

An embodiment of the present invention will be described with reference to the drawing. Links or beam portions 1 of the band are disposed longitudinally or lengthwise of the band with a slit 2 being provided between each pair of adjacent links. Link arms or arm portions 4 are protruded outwardly in the widthwise direction of the band from the opposed side surfaces 3 of each link of the band and are located closer to the slits between the links to define a pair of link arms between adjacent links. The pair of link arms 4 are connected to B-shaped curved elastic part or bridge portion 5 extending over the side surfaces of the adjacent links and lying in a plane which intersects with another plane containing a major surface of a link 1. Each of the B-shaped elastic parts 5 comprises a pair of end portions **5*a* connected to the corresponding link arms, a pair of flexible portions 5*b* extending away from each other in the band lengthwise direction, and an intermediate straight portion 5*c*, and is connected to the corresponding links only at the end portions 5a** connected with the link arms. All the above parts of the band are linked from one end of the band to the other end thereof without any break, and are formed integrally of a macromolecular material.

In this embodiment, the link arms 4, and the B-shaped elastic parts 5 having the portions 5a connected with the link arms, the flexible portions 5b, and the straight portion 5c together constitute elastic members.

When force is applied to the ends of the band so as to expand the band, the links of the band are subjected to the force as indicated by the arrows shown in the drawing. This force acts on the B-shaped elastic parts 5 through the link arms 4 of the links 1 of the band. By this action, the flexible portions 5b of the B-shaped elastic parts 5 are deformed in such a manner that the dimension X shown in the drawing decreases. In addition, in accordance with the deformation of the flexible portions 5b of the B-shaped elastic parts, the straight portions 5c of these parts are deformed in such a manner as to be bent upward. The B-shaped elastic parts are capable of being deformed in this manner until the dimension X reaches zero. When $X=0$, no further deformation is possible. If each B-shaped elastic part is deformed until $X=0$, each slit 2 between the links will be enlarged by a dimension of about 2X. Therefore, when it is assumed that there are N number of slits provided between the links of the entire band, the band will be expanded by a dimension which is approximately equal to $2X \times N$. Since the B-shaped elastic parts of the band are formed with an elastic material such as a macromolecular or polymer material, when the force applied to the ends of the band is removed, the band will contract to its original length with ease.

In view of the need to fit the band around the wrist, the band must be capable of bending with ease. Concerning this requirement, since the flexible portions 5b and the straight portion 5c of each B-shaped elastic member have sufficient flexibility for the band to bend so as to fit on the wrist without any problem.

The upper major surfaces of the links of the band may be aligned with the upper surfaces of the straight portions 5c of the B-shaped elastic parts, thereby improving the outer appearance of the band as viewed from above. Also, the lower major surfaces of the links of the band may be aligned with the lower surfaces of the flexible portions 5b of the B-shaped elastic parts, thereby stabilizing the condition of the band when placed around the wrist. In addition, an end piece part may be formed at one end of the band so that the band can be mounted to the wrist watch case.

With the expansion band for a watch constructed as described above, the following effects are achieved. First, since the entire structure consists of a single component part which is continuous without any break, a great reduction in the number of component parts can be achieved as compared with a conventional metal expansion band consisting of as many as 240 component parts. In addition, since there is only one component part, assembly is unnecessary. The band is completed by a single injection molding. Further, since a macromolecular material is used, coloring may be performed with ease, thus enabling production of a fashionable band.

Thus, in accordance with the present invention, all the problems encountered by the conventional expansion bands are solved.

What is claimed is:

1. An expansible integral band comprising: a plurality of beam portions disposed in side-by-side relation in the lengthwise direction of the band, each beam portion having two opposed side surfaces disposed in spaced-apart relation in the widthwise direction of the band so as to define for each pair of adjacent beam portions a corresponding pair of side surfaces adjacent to each other in the lengthwise direction, each pair of adjacent side surfaces having a pair of arm portions protruding outwardly from the respective adjacent side surfaces in the widthwise direction; and a plurality of elastic bridge portions integrated with the beam portions through the arm portions, each bridge portion being elastically connected between a pair of arm portions of adjacent beam portions to enable the integral band to expand and contract in the lengthwise direction, each bridge portion lying in a first plane which is parallel to the lengthwise direction and which intersects with a second plane which is parallel to both the lengthwise and widthwise directions, and each bridge portion being elastically deformable in the lengthwise direction along the first plane.

2. An expansible integral band according to claim 1; wherein the band comprises an expansible watch band.

3. An expansible integral band according to claim 1; wherein the beam portions and bridge portions are composed of a polymer material.

4. An expansible integral band according to claim 1; wherein each bridge portion lies in a first plane which intersects perpendicularly with the second plane.

5. An expansible integral band according to claim 1; wherein each bridge portion lies in a first plane parallel to a beam portion side surface.

6. An expansible integral band according to claim 1; wherein each bridge portion comprises a curved bridge portion having a pair of end portions connected to a pair of arm portions and extending away from each other in the lengthwise direction, and an intermediate portion curved to interconnect the pair of end portions with each other.

7. An expansible integral band according to claim 1; wherein the beam portion side surface has two arm portions spaced away from each other in the lengthwise direction such that one of the two arm portions belongs to one pair of adjacent arm portions and the other of the two arm portions belongs to another pair of adjacent arm portions.

* * * * *